US010255742B2

(12) United States Patent
Hecht et al.

(10) Patent No.: US 10,255,742 B2
(45) Date of Patent: Apr. 9, 2019

(54) METHOD FOR PROVIDING MEASUREMENT DATA OF A DEVICE FOR PROCESSING SECURITY DOCUMENTS AND SECURITY-DOCUMENT PROCESSING DEVICE

(71) Applicant: GIESECKE & DEVRIENT GMBH, Munich (DE)

(72) Inventors: Matthias Hecht, Neubiberg (DE); Karl-Dieter Forster, Deisenhofen (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 97 days.

(21) Appl. No.: 14/899,382

(22) PCT Filed: Jun. 26, 2014

(86) PCT No.: PCT/EP2014/001729

§ 371 (c)(1),
(2) Date: Dec. 17, 2015

(87) PCT Pub. No.: WO2014/206560

PCT Pub. Date: Dec. 31, 2014

(65) Prior Publication Data

US 2016/0148456 A1 May 26, 2016

(30) Foreign Application Priority Data

Jun. 27, 2013 (DE) ..... 10 2013 010 742

(51) Int. Cl.
*G07D 11/00* (2019.01)
*G07D 7/06* (2006.01)
(Continued)

(52) U.S. Cl.
CPC ..... *G07D 7/06* (2013.01); *G07D 7/00* (2013.01); *G07D 7/181* (2017.05); *G07D 7/183* (2017.05);
(Continued)

(58) Field of Classification Search
CPC ..... G07D 7/00; G07D 7/181; G07D 7/183; G07D 7/12; G07D 7/2075; G07D 7/2083;
(Continued)

(56) References Cited

U.S. PATENT DOCUMENTS 5,971,128 A 10/1999 Billington et al.
5,992,600 A 11/1999 Baudat
(Continued)

FOREIGN PATENT DOCUMENTS

DE 19646454 A1 5/1998
DE 10393676 T5 6/2006
(Continued)

OTHER PUBLICATIONS

German Search Report from Corresponding German Application No. 102013010742.3, dated Feb. 12, 2014.
(Continued)

*Primary Examiner* — Luis A Gonzalez
(74) *Attorney, Agent, or Firm* — Workman Nydegger

(57) ABSTRACT

Described is a method for providing measurement data for value documents to a specified purpose of use employing a value-document processing device which has a transport device for transporting the value documents, and a sensor device for capturing at least one property of value documents transported in the value-document processing apparatus by means of the transport device and forming measurement data describing the captured property, in which value documents are transported to the sensor device by means of the transport device and measurement data for these are respectively captured by means of the sensor device, it is tested whether the measurement data for the value documents meet a suitability criterion specified for the purpose of use, and measurement data for respectively one of the value documents either are permanently stored or discarded in dependence on the result of the testing.

17 Claims, 4 Drawing Sheets

(51) Int. Cl.

| | |
|---|---|
| ***G07D 11/16*** | (2019.01) |
| ***G07D 7/181*** | (2016.01) |
| ***G07D 7/183*** | (2016.01) |
| ***G07D 7/20*** | (2016.01) |
| ***G07D 7/00*** | (2016.01) |

(52) U.S. Cl.
CPC ..... *G07D 7/2075* (2013.01); *G07D 7/2083* (2013.01); *G07D 11/16* (2019.01); *G07D 2205/0012* (2013.01)

(58) Field of Classification Search
CPC ..... G07D 7/2091; G07D 11/0078; G07D 11/0084; G07D 11/0036; G07D 2205/0012
See application file for complete search history.

(56) References Cited

U.S. PATENT DOCUMENTS

| | | | | |
|---|---|---|---|---|
| 6,074,081 | A * | 6/2000 | Smith | B07C 5/361 209/534 |
| 6,305,550 | B1 | 10/2001 | Berz | |
| 6,811,016 | B2 | 11/2004 | Blair | |
| 7,789,243 | B2 * | 9/2010 | Hornung | G07D 7/00 194/206 |
| 9,058,710 | B2 * | 6/2015 | Jacomet | G07D 11/0036 |
| 9,406,184 | B2 * | 8/2016 | Chae | G07D 7/2058 |
| 9,666,007 | B2 * | 5/2017 | Hecht | G07D 7/00 |
| 9,805,259 | B2 * | 10/2017 | Hecht | G06K 9/00469 |
| 2003/0015395 | A1 | 1/2003 | Hallowell et al. | |
| 2004/0084277 | A1 | 5/2004 | Blair | |
| 2006/0169506 | A1 | 8/2006 | Handa et al. | |
| 2008/0054545 | A1 | 3/2008 | Calverley et al. | |
| 2011/0255767 | A1 | 10/2011 | Jenrick et al. | |
| 2013/0311477 | A1 | 11/2013 | Hecht et al. | |

FOREIGN PATENT DOCUMENTS

| | | |
|---|---|---|
| DE | 102010055974 A1 | 6/2012 |
| WO | 2004044678 | 5/2004 |

OTHER PUBLICATIONS

International Preliminary Report on Patentability for corresponding International PCT Application No. PCT/EP2014/001729, dated Dec. 29, 2015.
International Search Report for corresponding International PCT Application No. PCT/EP2014/001729, dated Sep. 23, 2014.

* cited by examiner

METHOD FOR PROVIDING MEASUREMENT DATA OF A DEVICE FOR PROCESSING SECURITY DOCUMENTS AND SECURITY-DOCUMENT PROCESSING DEVICE

BACKGROUND

The present invention relates to a method for providing measurement data for value documents to a specified purpose of use employing an apparatus for processing value documents and means for carrying out the method. Preferably, the purpose of use of the measurement data may comprise the adaptation of parameters of the apparatus.

In this context, value documents are understood to mean sheet-shaped objects, which represent for example a monetary value and thus shall not be manufacturable at will by unauthorized persons. They hence have features that are not simple to manufacture, in particular to copy, whose presence is an indication of authenticity, i.e. manufacture by an authorized body. Important examples of such value documents are vouchers, checks and in particular bank notes.

Value-document processing apparatuses, in particular bank note processing apparatuses, classify value documents, in particular bank notes, with respect to the value document type, in the case of bank notes with respect to the currency and/or the value and/or the authenticity and/or the quality and/or the orientation. The orientation of a value document is understood to mean in the following, in case of a rectangular value document, one of the four possible positions which can be obtained by rotations of the value document around its longitudinal and transverse axis by 180°, respectively. The quality of a value document is understood to mean in particular its state; the state of bank notes can be given, for example, by allocation to classes such as "fit for circulation" and/or "unfit for circulation" and/or "damaged" or "damaged" in connection with the kind of damage. The value documents can then for example be sorted and, where applicable, deposited in corresponding output regions in dependence on the classification. This will be explained by the example of value documents in the form of bank notes.

The classification is made on the basis of various physical properties of the individual, i.e. respectively processed bank note. Examples of such physical properties are optical properties, for example, color properties, magnetic properties or ultrasonic properties.

Upon the capture of the various physical properties of the individual bank note, i.e. the bank note to be respectively processed or respectively being processed, measurement data are generated by means of sensors upon the processing of bank notes in bank note processing apparatuses, which measurement data are employed for the classification. The measurement data of a respective sensor describe the physical property or properties captured by the respective sensor. Measurement data are in general understood to mean in the following in particular raw data formed by a sensor, which raw data are unprocessed, except for processing operations in the sensor and/or corrections, for example also with respect to calibration and/or elimination of noise or background portions.

The measurement data delivered by the sensors are evaluated in an attached evaluation device which at least partly can also be configured for controlling the value-document processing apparatus or as a control and evaluation device. Upon this evaluation, bank notes features which characterize the type of bank note, the authenticity and the quality of the bank note are ascertained by suitable evaluation methods. In dependence on the ascertained bank notes features, a classification result is then calculated by the evaluation device which subsequently ascertains in which output pocket of the bank note processing apparatus the bank note is to be deposited. When the evaluation device is configured as a control and evaluation device, this can drive a transport device of the bank note processing apparatus in dependence on the classification result.

The evaluation methods and the determination of the classification result must be adapted to the type of the bank notes to be processed and also to the requirements of the operators of bank note processing apparatuses. For this, the evaluation device, preferably at least one evaluating program running therein, is parameterizable, i.e. there are classification parameters whose values are presettable and which are employed upon the evaluation and classification or the determination of the classification result; this adaptation of the classification parameter values, also referred to as an adaptation of the classification parameters, is referred to as adaptation in the following.

For determining suitable classification parameters, the measurement data of corresponding, suitably specified bank notes are often employed for the classification parameter adaptation. More precisely, upon a measurement data acquisition for the specified bank notes with the bank note processing apparatus, in a first step, respective measurement data are captured and stored. In a second step, these measurement data are then used for determining the classification parameter values.

For enabling a good parameterization, upon the measurement data acquisition there are often captured measurement data for bank notes which differ in various processing properties, for example, in their type, in particular currency and/or value, and/or in their quality or state, in their authenticity and/or in their orientation in which they are transported past the sensors in the value-document processing apparatus.

The subsequent parameter determination then requires that the measurement data for the various processing properties can be accessed in a targeted fashion. The measurement data must hence be stored in accordingly different data structures, e.g. files. Moreover, there must be available information as to for which bank note the measurement data were determined.

Upon the provision of measurement data, often large numbers of bank notes are employed, so that very large amounts of data are accumulated, on the one hand, and errors occurring upon the provision of measurement data can only be detected and corrected with some effort, on the other hand.

The present invention is based on the object of stating a method for providing measurement data for value documents to a specified purpose of use employing a value-document processing apparatus for processing value documents, which method allows a simple provision of measurement data, and of providing means for carrying out the method. Preferably, the purpose of use comprises the adaptation of parameters of the value document processing device.

SUMMARY

The object is achieved by a method for providing measurement data for value-documents to a specified purpose of use employing a value-document processing device which has a transport device for transporting the value documents and a sensor device for capturing at least one physical property of value documents transported in the value-document processing apparatus by means of the transport device and forming measurement data describing the captured property, in which value documents are transported to the sensor device by means of the transport device and measurement data for these are respectively captured by means of the sensor device, it is tested whether the measurement data of the value documents meet a suitability criterion specified for the purpose of use, and measurement data for respectively one of the value documents either are permanently stored or discarded in dependence on the result of the testing.

The object is further achieved by an apparatus for processing value documents with a feeding device for value documents to be processed into which value documents are introducible and are outputable in singled form therefrom, an output device in which processed value documents are depositable, a sensor device for capturing at least one physical property of value documents transported in the value-document processing apparatus by means of the transport device and forming measurement data describing the captured property, a transport device for the singled transport of value documents from the feeding device to the sensor device and from the sensor device to the output device, and a control and evaluation device connected via signal connections with the sensor device and the transport device, which is configured to execute a method according to one of the preceding claims. The control and evaluation device is configured in particular to transport value documents to the sensor device by means of the transport device and to respectively capture measurement data for these by means of the sensor device, to test whether the measurement data for the value documents meet a suitability criterion specified for the purpose of use, and to either permanently store or discard measurement data for respectively one of the value documents in dependence on the result of the testing.

In the method, measurement values for value documents are determined by means of the value-document processing apparatus. For this, the value documents are transported, preferably in singled form, to the sensor device of the value-document processing apparatus by means of the transport device.

The sensor device captures at least one physical property of a value document. For this, it can have one or several sensors. If only one sensor is present, this is configured for capturing at least one physical property. If several physical properties are captured, there can also be employed several sensors which respectively capture at least one of the several physical properties. Examples of the properties of a value document are its remission and/or transmission properties in the visible region of the electromagnetic spectrum, in particular also resolved according to wavelengths or colors, the remission and/or transmission properties in the infrared and/or ultraviolet spectral region of the electromagnetic spectrum, luminescence properties, magnetic properties or remission or transmission properties for ultrasound in specified frequency regions as well as properties derived therefrom. Accordingly, the sensor device may have at least one optical sensor, in particular one color sensor and/or at least one IR sensor and/or one UV sensor, at least one luminescence sensor and/or one magnetic sensor and/or at least one ultrasonic sensor. The sensor device or its sensor or sensors, when capturing, form sensor signals, from which the measurement data can be obtained or which represent the measurement data.

Then it is tested, by means of a data processing device, preferably the control and evaluation device, whether the measurement data for the value documents meet a suitability criterion specified for the purpose of use. The suitability criterion is specified for the specified purpose of use and a criterion for whether or not the measurement data for a value document are treated as suitable for the purpose of use.

Preferably, from the measurement data captured for the value documents there can be determined specified features of the value documents, i.e. for a value document there is respectively determined at least one feature. The dependence of the suitability criterion on the measurement data can then be given by the dependence of the suitability criterion on the features. The suitability criterion then depends preferably on the at least one feature of the value document.

In the value-document processing apparatus, the control and evaluation device serves, among other things, for testing the suitability criterion. The control and evaluation device can be given, for example, by a module, such as for example a data processing device, to which the measurement data of the sensor device are supplied. However, the control and evaluation device may also be partly formed by respective parts of the sensor device or a respective part of the sensor or at least one of the sensors of the sensor device. The control and evaluation device is further configured for controlling the apparatus and, for this, is connected via signal connections with the evaluation device and at least the transport device.

In dependence on the result of the test, the measurement data for the respective value document either are permanently stored or discarded. Hence, only those of the measurement data which meet the suitability criterion are permanently stored. In dependence on the result of the testing, those of the measurement data which do not meet the suitability criterion are discarded.

In this way there can also be employed large amounts of value documents, in order to obtain measurement data for the specified purpose of use without measurement data unsuitable according to the suitability criterion having to be manually deleted individually later.

The suitability criterion can be firmly specified for the value-document processing apparatus. However, it is preferred that, in the method, filter data corresponding to the specified purpose of use are captured before the transport of the value documents to the sensor device, which filter data establish the suitability criterion, and that, upon testing, the suitability criterion specified by the filter data is employed. For this, the apparatus may further have a device by means of which filter data corresponding to the specified purpose of use are capturable, which filter data establish the suitability criterion. The device may comprise an input device such as a keyboard or a touch-sensitive display. Preferably, however, it comprises an interface for capturing data from an external storage device, for example, an USB interface for connecting a Flash memory or a hard disk or a network interface for connecting an external data processing device. This allows a very flexible alteration of the suitability criterion in dependence on the purpose of use. The filter data may preferably comprise data by means of which parameter values and/or features determinable from the measurement data for a value document are identifiable.

In principle, the suitability criterion is not subjected to restrictions, except that it depends on the measurement data, preferably at least on one feature. Preferably, the test of the suitability criterion may comprise the following tests alone or in combination. Such a test then corresponds to the test of a respective partial criterion. In the case that the test of the suitability criterion comprises a combination of tests, the suitability criterion may be met, for example, when at least a specified number of the tests, preferably each of the tests, yields a suitability for the purpose of use. The suitability criterion may also be considered to be not met, when at least one of the tests excludes a suitability; depending on the kind of the partial criteria other combinations of the results of the tests are possible.

According to a first possibility, it is preferred that in the method, upon testing the suitability criterion, it is tested whether the measurement data were captured for at least partly overlapping value documents and/or for singled value documents. Singled value documents are understood to be transported value documents which succeed one another but are separated by a gap. In the apparatus, the control and evaluation device is then configured that upon testing the suitability criterion it is tested whether the measurement data were captured for at least partly overlapping value documents and/or for singled value documents. In this way, measuring data for value documents which, for example, were not completely singled due to a singling error and still overlap each other, can simply be identified and discarded when, according to the purpose of use, such measurement data are useless. Then, the fact that the value document was captured in singled form can be employed as a feature.

According to a second possibility it is preferred in the method, that upon testing the suitability criterion it is tested whether a value document for which measurement data were captured was incorrectly aligned during the capture of the measurement data. In the apparatus, the control and evaluation device is then configured that upon testing the suitability criterion it is tested whether a value document for which measurement data were captured was incorrectly aligned during the capture of the measurement data. For testing whether the value document was incorrectly aligned upon the capture of the measurement data, there can be tested in particular an alignment criterion which preferably depends on the measurement data captured for the value document. For example, upon the test for the incorrect alignment, there can be tested during the capturing of the measurement data whether the value document is displaced, in a direction transverse to a transport direction along which it is transported past the sensor device, by more than a specified value and/or the value document with one of its margins or one of its edges is rotated by more than a specified critical angle in relation to a transport direction along which it is transported past the sensor device. An incorrect alignment can preferably be a reason for discarding the measurement data. Then, the suitable alignment of the value document can be employed as a feature.

According to a third possibility it is preferred in the method, that upon testing the suitability criterion it is tested whether a value document for which measurement data were captured has a specified value document type and/or a specified orientation. In the apparatus, the control and evaluation device is then configured that upon testing the suitability criterion it is tested whether a value document for which measurement data were captured has a specified value document type and/or a specified orientation. If measurement data are to be captured only for value documents of one or several specified types and/or orientations, there can be captured in this way, for example, measurement data only for value documents of the one or several specified types and/or orientations, while the measurement data for value documents of other types and/or orientations are discarded. Thus, for example when employing a stack with a large number of value documents of different types and alignments, one can do without a pre-sort, because only the measurement data for the suitable value documents are permanently stored. Then, the value document type or the orientation can be employed as a feature.

According to a further possibility, upon testing the suitability criterion in the method, it can be tested whether a value document for which measurement data were captured has defects, folds or dog-ears. In the apparatus, for this, the control and evaluation device can further be configured such that upon testing the suitability criterion it is tested whether a value document for which measurement data were captured has defects, folds or dog-ears. For many purposes of use, for example the test of a printed image of a value document, the stated properties can be disturbing, so that respective measurement data are discarded. By employing this embodiment, measurement data of respective value documents can be simply eliminated. Hence, the damage state or folding state can then be employed as a feature. Further partial tests or criteria are conceivable, depending on the purpose of use.

Although for some of the preceding possibilities it was mentioned that the measurement data for value documents which are regarded as double removals or have defects or folds are discarded, it may also be possible, depending on the purpose of use, to permanently store exactly these measurement data and to discard others, when the recognition of these features is to be enhanced. For example, the purpose of use may consist in adapting parameters in such a way that double removals or folds are recognized particularly well.

Preferably, the control and evaluation device is configured such that it is able to test several specified partial criteria, it being further configured to select and to employ, upon carrying out the method, only some of these partial criteria.

Depending on the result of the testing, the measurement data can be permanently stored or discarded. Permanently storing is understood here to mean a storing beyond at least the time at which the capturing of measurement data for a stack of value documents is completed, preferably at which the employed value-document processing apparatus is already switched off. In the method, preferably when discarding measurement data, the respective measurement data are deleted or at least not permanently stored. Not permanently storing is understood here to mean that the respective measurement data are stored only temporarily, preferably at most until the capture of the measurement data for the value document transported after next, particularly preferably at most until the capture of the measurement data for the value document transported next, and then are deleted or overwritten.

In a preferred development, in the method, for those measurement data which do not meet the suitability criterion, an error message can be permanently stored and/or output, preferably be displayed by means of a display device, in dependence on the result of the testing. Particularly preferably, an identifier for the respective one value document or the respective value documents for which measurement data were discarded can be stored and/or output, which identifier unambiguously marks the value document or the value documents at least among the value documents employed upon the measurement data capture process. In the apparatus, the control and evaluation device can be configured to permanently store and/or output, preferably display by means of a display device, an error message for those measurement data which do not meet the suitability criterion, in dependence on the result of the testing. Particularly preferably, it can be configured, in doing so, to store and/or output an identifier for the respective one value document or the respective value documents for which measurement data were discarded, which identifier unambiguously marks the value document or the value documents at least among the value documents employed upon the measurement data capture process. This procedure has the advantage that it can be easily understood that no measurement data were captured for value documents and which value documents these were.

The measurement data to be permanently stored can basically be permanently stored in any way. Thus, the measurement data to be permanently stored can be permanently stored, in the method, preferably in a remote data processing apparatus and/or in an external storage device. In the apparatus, for this, the control and evaluation device can further be configured such that it can transmit measurement data to be permanently stored to a remote data processing apparatus or an external storage device. For this, the value-document processing apparatus may have a respective interface, which may also be part of the device, by means of which filter data are read. For example, such interfaces may comprise network interfaces, e.g. Ethernet or fibre channel interfaces of high transmission rates, or USB, FireWire or Thunderbolt interfaces. Other interfaces are also possible. This embodiment also allows a cost-efficient storage of large amounts of measurement data.

Alternatively or additionally, the measurement data to be permanently stored can be permanently stored, in the method, in a storage device of the value-document processing apparatus. For this purpose, the apparatus may preferably have a storage device for storing the captured measurement data, or the control and evaluation device may have a storage device for storing the captured measurement data, and the control and evaluation device in both cases may be configured for permanently storing the measurement data, which are to be permanently stored, in the storage device. This alternative has the advantage of a lower effort.

The control and evaluation device of the apparatus may in principle be constructed at will, but of course must be capable of executing the explained functions. Preferably, however, the control and evaluation device of the apparatus has at least one processor which can execute program code of a computer program stored in at least one program storage, in such a way that the method according to the invention is executed. Subject matter of the invention is hence also a computer program which contains program code upon the execution of which by means of a processor of a control and evaluation device of a value-document processing apparatus which has a feeding device for value documents to be processed, into which value documents are introducible and are outputable in singled form therefrom, an output device in which processed value documents are depositable, a sensor device for capturing at least one property of value documents, and a transport device for the singled transport of value documents from the feeding device to the sensor device and from the sensor device to the output device, the method of the invention is executed.

A further subject matter of the invention is a physical data carrier on which a computer program of the invention is stored. The program is permanently stored thereon, i.e. in this case not only during the execution of the program or the operation of an apparatus containing the data carrier.

In the apparatus, the control and evaluation device has preferably at least one processor and a program storage in which a computer program of the invention is stored.

BRIEF DESCRIPTION OF THE DRAWINGS

The invention will hereinafter be explained further by way of example with reference to the drawings. There are shown.

DETAILED DESCRIPTION OF VARIOUS EMBODIMENTS

Figure 1:
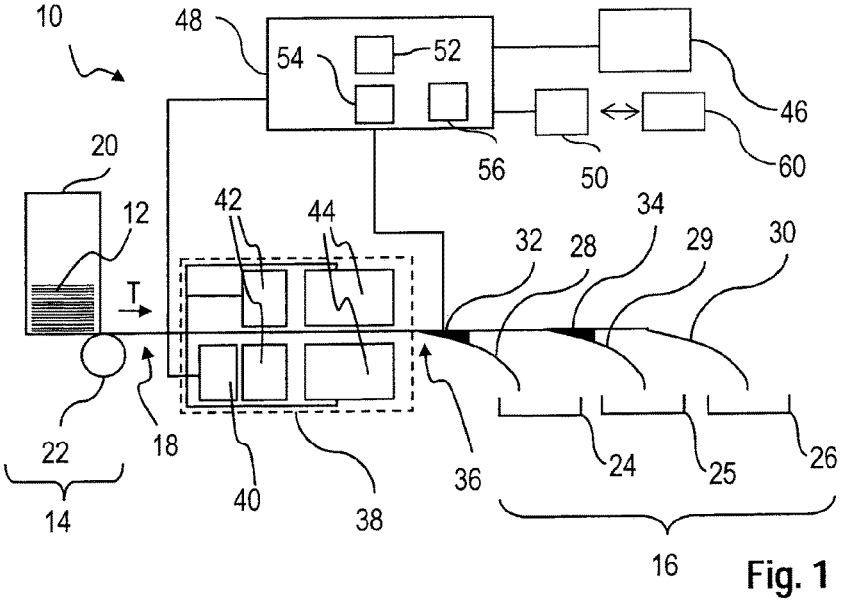
FIG. 1 a schematic view of a value-document processing apparatus in the form of a bank-note sorting apparatus, FIG. 2 a simplified flowchart of a first embodiment of a method for providing measurement data, which can be carried out by means of the apparatus of FIG. 1, FIG. 3 a simplified flowchart of a second embodiment of a method for providing measurement data, which can be carried out by means of the apparatus of FIG. 1, and FIG. 4 a simplified flowchart of a third embodiment of a method for providing measurement data, which can be carried out by means of the apparatus of FIG. 1.

A value-document processing apparatus 10 in FIG. 1, in the example an apparatus for processing value documents 12 in the form of bank notes, is configured for sorting value documents in dependence on the recognition of the authenticity and of the state of processed value documents. The components of the apparatus described in the following are arranged in a housing (not shown) of the apparatus or are held at this, unless they are referred to as external.

The apparatus has a feeding device 14 for feeding value documents, an output device 16 for receiving processed, i.e. sorted value documents, and a transport device 18 for transporting singled value documents from the feeding device 14 to the output device 16.

The feeding device 14 comprises, in the example, an input pocket 20 for a value-document stack and a singler 22 for singling value documents out of the value-document stack in the input pocket 20 and for feeding the singled value documents to the transport device 18.

The output device 16 comprises, in the example, three output portions 24, 25 and 26 into which processed value documents can be sorted, sorted according to the result of the processing. In the example, each of the portions comprises a stack pocket and a stacking wheel (not shown) by means of which fed value documents can be deposited in the stack pocket.

The transport device 18 has at least two, in the example three, branches 28, 29 and 30 at whose ends one of the output portions 24, 25, 26 is respectively disposed, and, at the branching points, gates 32 and 34 controllable by actuating signals for feeding value documents to the branches 28 to 30 and thus to the output portions 24 to 26 in dependence on actuating signals.

On a transport path 36, defined by the transport device 18, between the feeding device 14, in the example more precisely the singler 22, and the first gate 32 after the singler 22 in the transport direction there is disposed a sensor device 38 which measures physical properties of the value documents when value documents are being transported past, and forms sensor signals representing the measurement results. In this example, the sensor device 38 has three sensors, namely an optical remission sensor 40 which captures a remission color image and a remission IR image of the value document, an optical transmission sensor 42 which captures a transmission color image and a transmission IR image of the value document, and a transmission ultrasonic sensor 44 which captures or measures ultrasound transmission properties of the value document in a spatially resolved manner and will hereinafter only be referred to as an ultrasonic sensor for simplicity's sake. The sensor signals formed by the sensors correspond to measurement data or raw data of the sensors, which, depending on the sensor, could already have been subjected to a correction, for example in dependence on calibrating data and/or noise properties.

For the capture and display of operating data, the value-document processing apparatus 10 has an input/output device 46 which comprises a display device. The input/output device 46 is implemented, in the example, by a touch-sensitive display device ("touch screen"). In other embodiments, it may comprise, for example, a keyboard and a display device, for example an LCD display.

A control and evaluation device 48 is connected via signal connections with the sensor device 38 of the display device 46 and the transport device 18, in particular the gates 32 and 34. Further, a data interface 50 is connected with the control and evaluation device 48, by means of which the control and evaluation device of 48 can read records of an external device. In the present example, the data interface 50 has an USB interface with an USB connector, via which data can be read from an external storage device 60, in the example a USB storage medium, and/or can be written thereon.

The value-document processing apparatus 10 is configured to be operated in two operating modes or modes of operation, a sorting operating mode for sorting value documents in dependence on their state or quality and their authenticity and a measurement data capture operating mode for capturing measurement data for specified value documents. In particular, the control and evaluation device 48 is accordingly configured for this.

In the sorting operating mode, value documents are singled from the feeding device and transported past the sensor device 38 or through this. The sensor device 38 captures or measures physical properties of the value document respectively transported past or through it and forms sensor signals or measurement data which describe the measurement values for the physical properties. The control and evaluation device 48 classifies the value document, in dependence on the sensor signals of the sensor device 38 for a value document and on classification parameters stored in the evaluation device, and by emitting actuating signals drives the transport device 18, here more precisely the gates 32 or 34, such that the value document is output, corresponding to its class determined upon the classification, into an output portion of the output device 16, which is associated with the class. The association with one of the specified authenticity classes, or the classification, is effected here in dependence on at least one specified authenticity criterion.

In the measurement data capture operating mode, value documents are singled from the feeding device and transported past the sensor device 38 or through this. The sensor device 38 captures or measures physical properties of the value document respectively transported past or through it and forms sensor signals which correspond to measurement data which describe the measurement values for the physical properties. The control and evaluation device 48 captures the sensor signals and stores respective measurement data at least temporarily. After the capture, the value documents are stacked in the output device 16, for example in the output portion 24.

For this, the control and evaluation device 48 has in particular, besides corresponding data interfaces for the sensor device 38 or their sensors (not shown in the Figures), a processor 52 and a storage 54 connected with the processor 52, in which at least one computer program with program code is stored upon the execution of which the processor 52 controls the apparatus according to the operating mode. Thus, it can evaluate the sensor signals or measurement data, in particular for determining an authenticity class of a processed value document, and drive the transport device 18 or store the measurement data, according to the evaluation. The value-document processing apparatus 10 further has a measurement data storage 56 connected with the processor 52, which may be part of the control and evaluation device 48, as represented in FIG. 1, or separated from this. This measurement data storage is in this embodiment a nonvolatile storage, for example a hard disk.

Further, the control and evaluation device 48 drives the input/output device 46 such, among other things, that it displays operating data, and captures via these operating data which correspond to inputs of an operator.

In the following, there are described the aspects of the value-document processing apparatus 10 which relate in particular to the measurement data capture operating mode.

Figure 2:
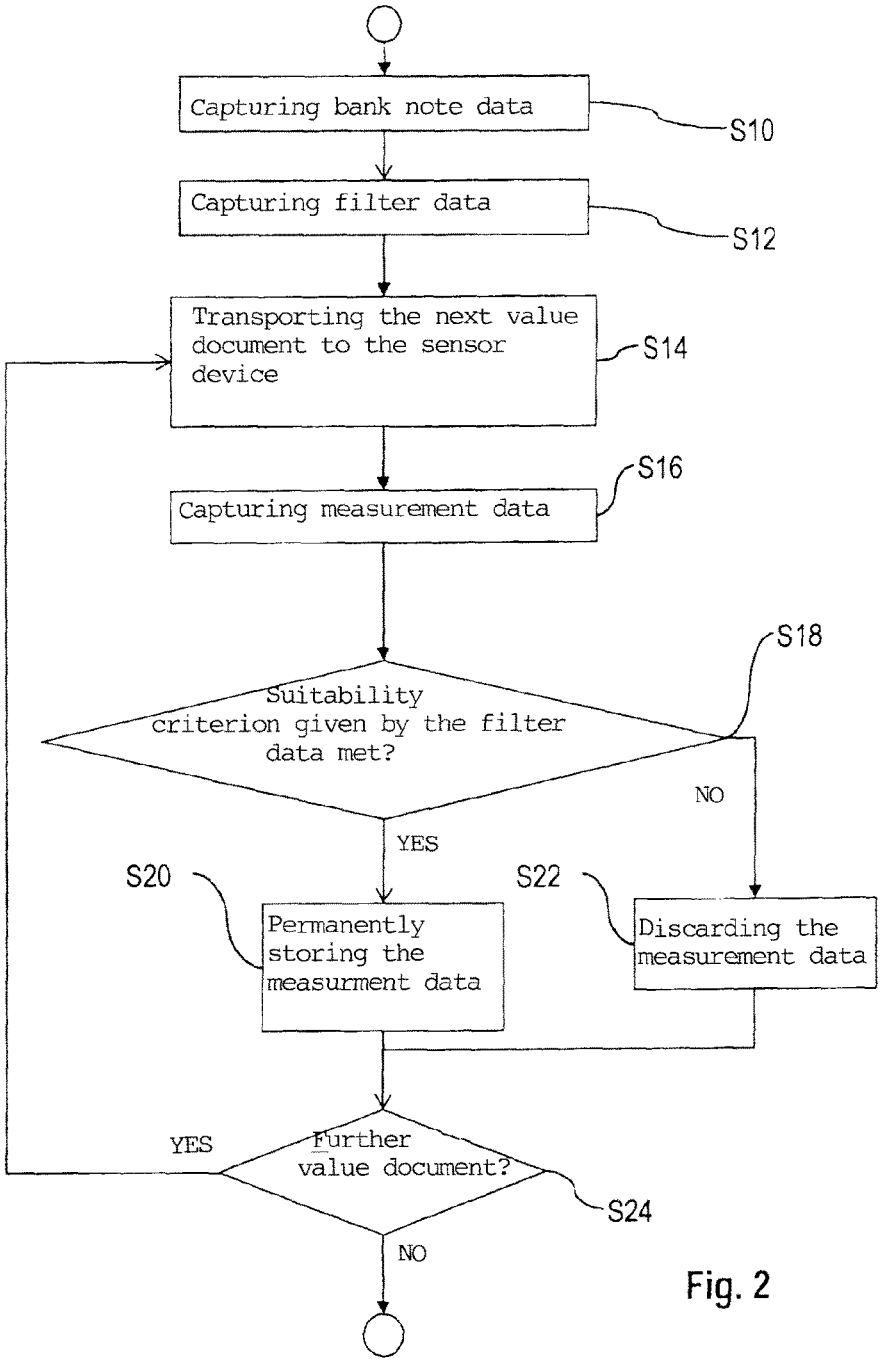

The computer program stored in the control and evaluation device 48 has in particular instructions to carry out the method for providing measurement data for value documents to a specified purpose of use, which is described in the following and illustrated in FIG. 2.

Measurement data are to be captured for the purpose of use of adapting classification parameters of the value-document processing apparatus 10 or for a different value-document processing apparatus. For carrying out the method described in the following, the value-document processing apparatus 10 needs to have only classification parameters which make it possible to test the suitability criterion described in the following.

First, in step S10, bank note data are captured, which state the order, the type and the orientation of the bank notes, which subsequently are to be fed to the value-document processing apparatus 10. This occurs in the present embodiment via the data interface 50, to which an external storage device 60, in the example a USB storage medium 60, i.e. a storage medium connectable by means of an USB interface, is connected, on which the corresponding data are stored. After having capturing the start signal of the input/output device 46, the control and evaluation device 48 reads these data from the external storage device 60 and stores them.

In the following step S12, the control and evaluation device 48 captures filter data which establish the suitability criterion employed in the following. The suitability criterion is a criterion for whether measurement data captured for a value document are suitable for the specified purpose of use. For this, the control and evaluation device 48 in the present embodiment drives the input/output device 46 such that a menu is displayed thereon which shows selectable partial criteria of the suitability criterion and possible logical combinations, i.e. "and" or "or" combinations between the selected partial criteria. Then it captures possible inputs of a user, with which the user sets the respective partial criteria and their logical combinations.

In this example, the following choices for partial criteria are given:

- The value document has the feature that the value document is singled, i.e. no double removal was recognized with which value documents overlap upon the capture of the measurement data. For the determination of the feature or for the test of the partial criterion, the measurement data of the ultrasonic sensor are used in a per se known manner.
- The value document has the feature that it has an adequate mechanical state, i.e. neither has dog-ears nor torn-off parts. For determining the feature or testing the partial criterion, the measurement data of the optical transmission sensor 42 are employed.
- The value document has the feature that, upon the capture of the measurement data, it has a sufficiently good position relative to the sensor device 38, i.e. that the value document edge substantially extending in the transport direction is rotated at most by a specified angle, for example an angle of 5°, in relation to the transport direction and this edge is less than a specified distance apart from a specified center of the transport path or capture region of the sensor device. For this, in the example, the measurement data of the optical remission sensor 40 are employed.

The value document has the feature that it has the correct, according to the captured bank note data, type and the correct orientation. For this, in the example, the measurement data of the optical remission sensor 40 are employed. In the control and evaluation device 48 corresponding reference data must be stored for this purpose.

According to the specified choices, the control and evaluation device 48, in particular its computer program, is configured such that each of the partial criteria can be tested, when it is selected as a partial criterion.

The control and evaluation device 48 stores respective filter data which establish which of the partial criteria are to be tested and how they are to be logically combined with each other, so that measurement data are recognized as being suitable for the specified purpose of use.

Now the steps S14 to S24 are carried out, until all value documents for which measurement values are to be captured according to the bank note data, are singled. Depending on the operating speed of the apparatus 10, in so doing, certain steps for a value document can be executed at least partly parallel with other steps for a next value document, in the example, for example, during the capture of measurement data for a singled value document there could already be singled a further value document in step S14.

More precisely, the control and evaluation device 48 drives in step S14 the input device 14, in particular the singler 22, and the transport device 18 in such a way that a value document of the value document stack in the pocket 20 is singled and transported by means of the transport device 18 to the sensor device 38.

In step S16, the sensor device 38 then captures measurement data for the value document. The measurement data are transmitted to the control and evaluation device 48 which temporarily stores these data in the storage 54.

In step S18, the control and evaluation device 48 tests whether the measurement data captured for the value document meet the suitability criterion. For this, first it tests successively or at least partly in parallel the selected partial criteria and combines the results according to the selected logical combinations. The result is the result of the test of the suitability criterion. The control and evaluation device 48 then forms a corresponding suitability signal which represents the result of the test and stores respective data. If, for example, as a partial criteria there was selected that the value document is to be present in singled form and that the value document is to have a sufficiently good position, and that for meeting the suitability criterion both partial criteria must be met, i.e. they must be logically combined with "and", the control and evaluation device tests, employing the measurement data, whether the value document was present in singled form during the capture of the measurement data and whether its position was sufficiently good.

If the result of testing the suitability criterion is negative, the control and evaluation device 48 discards the measurement data in step S22, by deleting the measurement data from the storage 54 in the present embodiment. Preferably, in a log file in the storage 56 there are stored an identifier for the value document, for example the position in the row of the value documents fed, and data which indicate that for the value document no measurement data were captured for the specified purpose of use.

If the result of testing the suitability criterion is positive, the control and evaluation device 48 permanently stores the measurement data for the value document in step S20. For this, the control and evaluation device 48 moves the measurement data temporarily stored in the storage 54 from the storage 54 into the storage 56 and stores them permanently there, preferably together with the above-mentioned identifier. Then the measurement data are no longer located in the storage 54.

Thereafter, in step S24 it is tested whether a further value document lies ready for singling. If this is the case, the method is continued with step S14, otherwise it is terminated.

In the present case, the storage 56 is a hard disk on which the measurement data remain permanently stored, even when the method is terminated. The stored data can be left in the storage 56 and/or stored via the data interface 50 in the external storage device 60.

Figure 3:
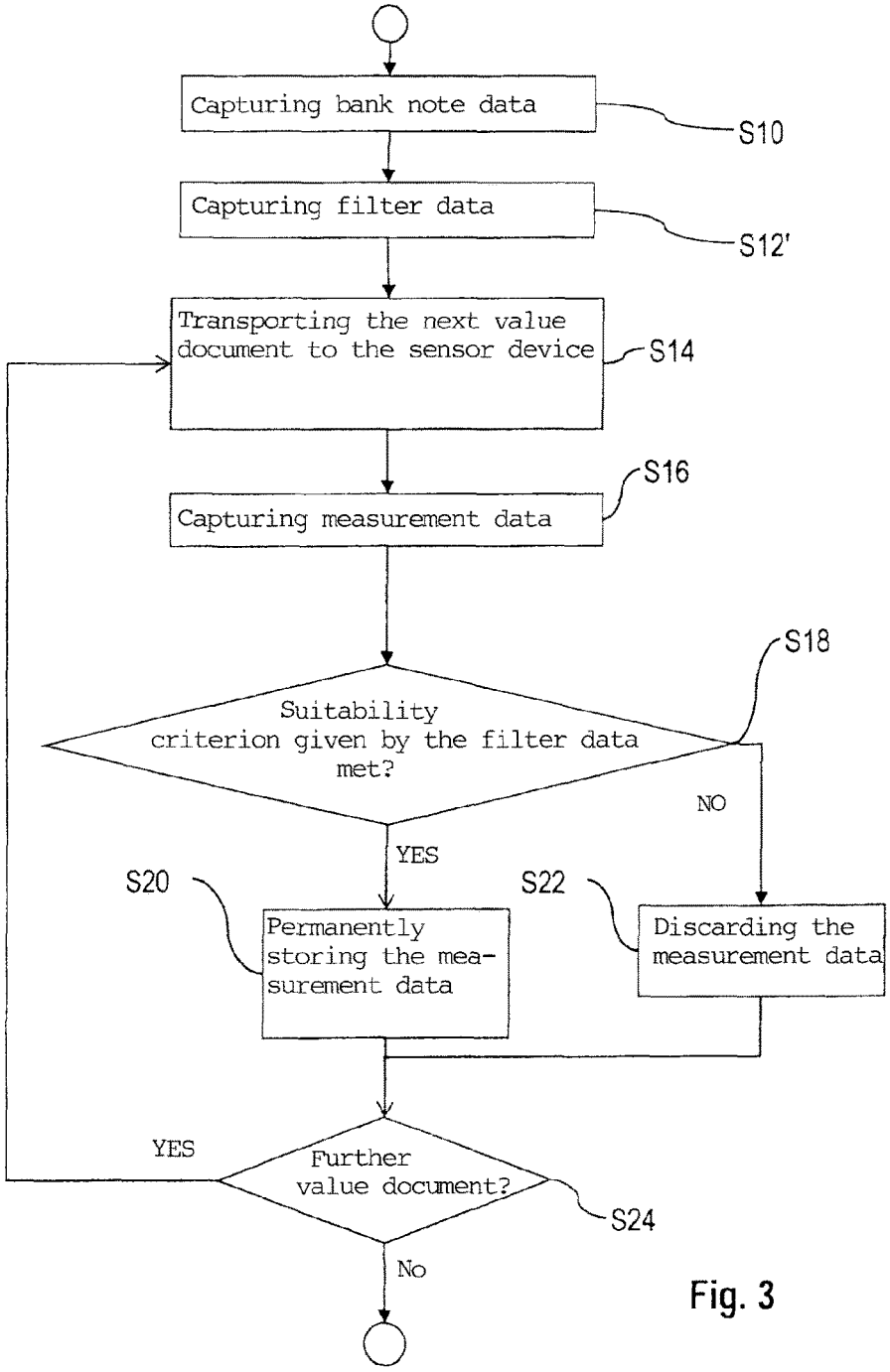

A second exemplary embodiment illustrated in FIG. 3 differs from the first embodiment only in the fact that the step S12 is replaced by the step S12', i.e. the capture of the filter data is carried out differently. All the other steps are unaltered.

In step S12', the control and evaluation device 48 now captures the filter data by reading the filter data from a corresponding file, which is stored in the external storage device 60, by means of the data interface 50. For this, keywords are specified for the partial criteria and it is specified how the logical combinations between the partial criteria are to be stated in the data file. In the data file there are then located the keywords for the partial criteria to be employed as well as the logical combination of the data representing partial criteria. The control and evaluation device 48 captures the data, searches therein for the specified keywords and data for the logical combination and employs these upon carrying out the further method analogous to the first exemplary embodiment; there are carried out the partial tests corresponding to the keywords, their results are combined according to the stated logical combinations and the combination result is employed as the result of testing the suitability criterion. As in the first exemplary embodiment, the control and evaluation device 48, in particular its computer program, is configured, according to the specified choices, such that each of the partial criteria can be tested, when it is selected as a partial criterion.

Figure 4:
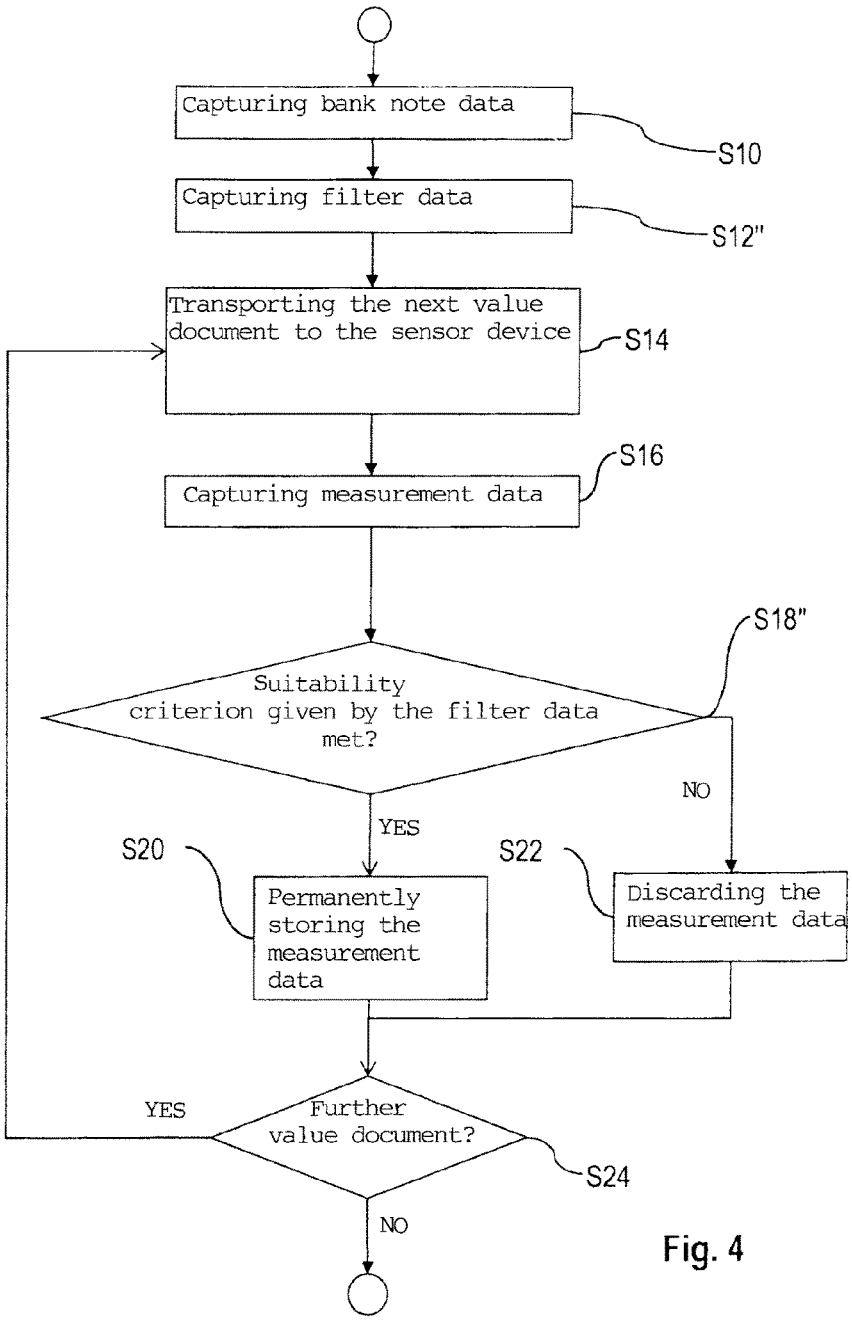

A third exemplary embodiment illustrated in FIG. 4 differs from the second exemplary embodiment, among other things, in the fact that the purpose of use of the measurement data is a different one. The purpose of use of the measurement data is to enhance the adaptation of parameters for the recognition of serial numbers. For this, as a further partial criterion there is employed that the value document has the feature that the serial number is readable. This means that a serial number can be recognized, without the recognized serial number having to be recognized correctly. For this purpose, the measurement data of the optical remission sensor 40 are employed.

For this, now the step S12' is replaced by the step S12" and the step S18 by the step S18". All the other steps are unaltered.

The step S12" differs from step S12' in that there is provided as an employable keyword, in addition to the keywords of the second exemplary embodiment, a keyword for the partial criterion that the value document has the feature that the serial number is readable. The control and evaluation device 48 or the computer program is modified to the effect that it tests filter data read in also for the existence of the keyword for the readability of the serial number and when finding the keyword it accordingly executes the method to be carried out in the following, in particular the test of the corresponding partial criterion.

For this, in step S18" it is provided that in the case of filter data comprising the keyword for the readability of the serial number, as a partial criterion it is tested, in dependence on the measurement data of the optical remission sensor 40, whether the value document has the feature that the serial number is readable. The result of the testing of this partial criterion is combined, corresponding to the logical combinations contained in the filter data, with the results of the testing of other selected partial criteria and employed as the result of testing the suitability criterion.

The other steps are unaltered.

In this way it is possible, without a pre-sort of the value documents which are fed to the apparatus, to capture only measurement data for value documents which are suitable for enhancing the serial number reading.

Other embodiments differ from the preceding exemplary embodiments in that as a data interface 50 there is provided a network interface, preferably a wired network place, for example, a gigabit Ethernet interface. The external storage device 60 is then given by a storage connected by means of the network interface, for example a hard disk of a remote computer.

Still further exemplary embodiments may differ from the preceding exemplary embodiments in that the storage 56 is omitted and storing processes, i. e. storing measurement data determined to be suitable and optionally also the log file, occur directly by means of the data interface 50 in the external storage device 60.

The invention claimed is:

1. A method for providing measurement data for value documents to a specified purpose of use employing a value-document processing device which has a transport device for transporting the value documents and a sensor device for capturing at least one property of value documents transported in the value-document processing apparatus by means of the transport device and forming measurement data describing the captured property, the method comprising:

transporting value documents to the sensor device by means of the transport device and measurement data for each individual value document are respectively captured by means of the sensor device;

testing whether the captured measurement data for each of the value documents meet a suitability criterion specified for the purpose of use;

permanently storing the captured measurement data for each of the tested value documents that meets the suitability criterion specified for the purpose of use; and discarding the captured measurement data for each of the tested value documents that does not meet the suitability criterion specified for the purpose of use.

2. The method according to claim 1, wherein filter data corresponding to the specified purpose of use are captured before the transport of the value documents to the sensor device, which filter data establish the suitability criterion; and the suitability criterion specified by the filter data is employed upon testing.

3. The method according to claim 1, wherein upon testing the suitability criterion it is tested whether the measurement data were captured for at least partly overlapping value documents and/or for singled value documents.

4. The method according claim 1, wherein upon testing the suitability criterion it is tested whether a value document for which measurement data were captured was incorrectly aligned upon the capture.

5. The method according to claim 1, wherein upon testing the suitability criterion it is tested whether a value document for which measurement data were captured has a specified value document type and/or a specified orientation.

6. The method according to claim 1, wherein upon testing the suitability criterion it is tested whether a value document for which measurement data were captured has defects or dog-ears.

7. The method according to claim 1, wherein upon discarding measurement data the measurement data are deleted or not permanently stored.

8. The method according to claim 1, wherein, in dependence on the result of the testing, for those measurement data which do not meet the suitability criterion an error message is permanently stored and/or output, preferably displayed by means of a display device.

9. The method according to claim 1, wherein the measurement data to be permanently stored are permanently stored in a remote data processing apparatus and/or in an external storage.

10. The method according to claim 1, wherein the measurement data to be permanently stored are permanently stored in a storage device of the value-document processing apparatus.

11. The method according to claim 1, wherein upon permanently storing or discarding the measurement data for the one of the value documents, an identifier for the one of the value documents is stored with data indicating whether the measurement data was discarded.

12. An apparatus for processing value documents, comprising:

a feeding device for value documents to be processed, into which value documents are introducible and are outputable in singled form therefrom;

an output device in which processed value documents are depositable;

a sensor device for capturing at least one property of value documents transported in the value-document processing apparatus by means of the transport device and forming measurement data describing the captured property;

a transport device for the singled transport of value documents from the feeding device to the sensor device and from the sensor device to the output device; and a control and evaluation device connected via signal connections with the sensor device and the transport device;

wherein the control and evaluation device is configured to test whether the captured at least one property for each of the value documents meets a suitability criterion specified for the purpose of use, to permanently store the captured at least one property for each of the tested value documents that meets the suitability criterion specified for the purpose of use, and to discard the captured at least one property for each of the tested value documents that does not meet the suitability criterion specified for the purpose of use.

13. The apparatus according to claim 12, further comprising a device by means of which filter data corresponding to the specified purpose of use are capturable, which filter data establish the suitability criterion.

14. The apparatus according to claim 12, wherein the control and evaluation device is further configured such that it can transmit measurement data to be permanently stored to a remote data processing apparatus or an external storage.

15. The apparatus according to claim 12, further comprising a storage device for storing the captured measurement data, or in which the control and evaluation device has a storage device for storing the captured measurement data, and in which the control and evaluation device is configured for permanently storing the measurement data, which are to be permanently stored, in the storage device.

16. A system for measurement data for value documents to a specified purpose of use employing a value-document processing device, the system comprising:

a program code upon the execution of which by means of a processor of a control and evaluation device of a value-document processing apparatus having a feeding device for value documents to be processed, into which value documents are introducible and are outputable in singled form therefrom;

an output device in which processed value documents are depositable;

a sensor device for capturing at least one property of value documents; and a transport device for the singled transport of value documents from the feeding device to the sensor device and from the sensor device to the output device;

wherein the control and evaluation device is configured to test whether the captured at least one property for each of the value documents meets a suitability criterion specified for the purpose of use, to permanently store the captured at least one property for each of the tested value documents that meets the suitability criterion specified for the purpose of use, and to discard the captured at least one property for each of the tested value documents that does not meet the suitability criterion specified for the purpose of use.

17. A non-transitory data carrier on which a computer program according to claim 16 is stored.

* * * * *